US008183777B2

(12) United States Patent
Hashimoto et al.

(10) Patent No.: US 8,183,777 B2
(45) Date of Patent: May 22, 2012

(54) LOW POWER CONSUMPTION PLASMA DISPLAY PANEL

(75) Inventors: Jun Hashimoto, Osaka (JP); Masashi Gotou, Osaka (JP)

(73) Assignee: Panasonic Corporation, Osaka (JP)

( * ) Notice: Subject to any disclaimer, the term of this patent is extended or adjusted under 35 U.S.C. 154(b) by 22 days.

(21) Appl. No.: 12/866,141

(22) PCT Filed: Dec. 10, 2009

(86) PCT No.: PCT/JP2009/006756
§ 371 (c)(1),
(2), (4) Date: Aug. 4, 2010

(87) PCT Pub. No.: WO2010/070847
PCT Pub. Date: Jun. 24, 2010

(65) Prior Publication Data

US 2010/0320901 A1 Dec. 23, 2010

(30) Foreign Application Priority Data

Dec. 15, 2008 (JP) ..... 2008-317940

(51) Int. Cl.
*H01J 17/49* (2012.01)

(52) U.S. Cl. ..... 313/587; 313/582; 313/584; 313/586

(58) Field of Classification Search ..... 313/582–587
See application file for complete search history.

(56) References Cited

U.S. PATENT DOCUMENTS 7,218,050 B2 * 5/2007 Hasegawa et al. ..... 313/587
7,659,871 B2 * 2/2010 Kim et al. ..... 345/60
7,728,523 B2 * 6/2010 Nishimura ..... 313/586
7,812,534 B2 * 10/2010 Yamamoto et al. ..... 313/582
7,816,869 B2 * 10/2010 Morita et al. ..... 313/587

(Continued)

FOREIGN PATENT DOCUMENTS

JP 08-236028 9/1996

(Continued)

OTHER PUBLICATIONS

International Search Report issued Feb. 2, 2010 in International (PCT) Application No. PCT/JP2009/006756.

*Primary Examiner* — Anne Hines
*Assistant Examiner* — Jose M Diaz
(74) *Attorney, Agent, or Firm* — Wenderoth, Lind & Ponack, L.L.P.

(57) ABSTRACT

A high definition plasma display panel which can display a video of a higher brightness and yet can be driven at a low power consumption is realized. To this end, a plasma display panel includes front panel including display electrode formed on glass substrate, dielectric layer 8 covering display electrode, and protective layer formed on dielectric layer; and a rear panel opposing to front panel to form a discharge space filled with discharge gas, and including an address electrode formed along a direction intersecting with display electrode, and a barrier rib partitioning the discharge space. Protective layer is formed of a metal oxide made of magnesium oxide and calcium oxide and contains silicon. In an X-ray diffraction analysis on a surface of protective layer, a diffraction angle where a peak of the metal oxide occurs exists between a diffraction angle where a peak of the magnesium oxide occurs and a diffraction angle where a peak of the calcium oxide occurs.

2 Claims, 6 Drawing Sheets

U.S. PATENT DOCUMENTS

| | | | | |
|---|---|---|---|---|
| 7,990,067 | B2 * | 8/2011 | Naoi et al. | 313/586 |
| 8,004,190 | B2 * | 8/2011 | Tsujita et al. | 313/582 |
| 2006/0134437 | A1 | 6/2006 | Lee et al. | |
| 2009/0140652 | A1 | 6/2009 | Fukui et al. | |
| 2009/0146566 | A1 | 6/2009 | Fukui et al. | |
| 2009/0160338 | A1 | 6/2009 | Wada et al. | |

FOREIGN PATENT DOCUMENTS

| | | |
|---|---|---|
| JP | 10-334809 | 12/1998 |
| JP | 11-339665 | 12/1999 |
| JP | 2000-103614 | 4/2000 |
| JP | 2002-260535 | 9/2002 |
| JP | 2005-264272 | 9/2005 |
| JP | 2006-059779 | 3/2006 |
| JP | 2006-169636 | 6/2006 |
| JP | 2008-21660 | 1/2008 |
| JP | 2008-91074 | 4/2008 |
| WO | 2008/010268 | 1/2008 |

* cited by examiner

70

LOW POWER CONSUMPTION PLASMA DISPLAY PANEL

This application is a National Stage application of International application PCT/JP2009/006756, filed Dec. 10, 2009.

TECHNICAL FIELD

The present invention relates to plasma display panels to be used in display devices.

BACKGROUND ART

A plasma display panel (hereinafter referred to simply as a PDP) allows achieving a high definition display and a large-size screen, so that television receivers (TV) with large screens of as large as 100 inches diagonal length can be commercialized by using the PDP. In recent years, use of the PDPs in high-definition TVs, which need more than doubled scanning lines than conventional NTSC method, has progressed. The PDP has been demanded to further reduce the power consumption in order to meet the energy-saving trend, and the PDP free from lead (Pb) has been also required in order to contribute to environment protection.

The PDP is basically formed of a front panel and a rear panel. The front panel is configured by a glass substrate made of sodium-borosilicate-based float glass; display electrodes, formed of striped transparent electrodes and bus electrodes, formed on a principal surface of the glass substrate; a dielectric layer covering the display electrodes and working as a capacitor; and a protective layer made of magnesium oxide (MgO) and formed on the dielectric layer.

The rear panel is configured by a glass substrate; striped address electrodes formed on a principal surface of the glass substrate; a primary dielectric layer covering the address electrodes; barrier ribs formed on the primary dielectric layer; and phosphor layers formed between each one of the barrier ribs, for emitting lights in red, green, and blue respectively.

The front panel confronts the rear panel such that its electrode-mounted surface confronts an electrode-mounted surface of the rear panel, and peripheries of both panels are sealed in an airtight manner to form a discharge space between two panels, and the discharge space is partitioned by the barrier ribs. The discharge space is filled with discharge gas of Neon (Ne) and Xenon (Xe) at a pressure ranging from 400 Torr (53300 Pa) to 600 Torr (80000 Pa). The PDP allows displaying a color video this way: Voltages of video signals are selectively applied to the display electrodes for discharging, thereby producing ultra-violet rays, which excite the phosphor layers for each color, so that colors in red, green, and blue are emitted, whereby a color video can be displayed.

The PDP discussed above is driven, in general, by a driving method which has an initializing period for adjusting wall charges into an easy-addressable state, an address period for carrying out address-discharge in response to input video signals, and a sustain period for displaying a video by generating sustain-discharge in a discharge space where an address has been done. A time span formed of the foregoing periods combined together is referred to as a subfield, and this subfield is repeated several times within one field corresponding to one frame of a video, thereby achieving a gray scale of the PDP.

The protective layer formed on the dielectric layer of the front panel of the foregoing PDP is expected to carry out the two major functions: protecting the dielectric layer from ion impact caused by the discharge, and emitting primary electrons for generating address discharges. The protection of the dielectric layer from the ion impact plays an important role for preventing a discharge voltage from rising, and the emission of primary electrons for generating the address discharges also plays an important role for eliminating an erroneous address discharge because the error causes flickers on videos.

To reduce the flickers on videos, the number of primary electrons emitted from the protective layer should be increased. For this purpose, impurities are added to magnesium oxide (MgO), or particles of MgO are formed on the protective layer made of MgO. These instances are disclosed in, e.g. Patent Literatures 1, 2, 3, 4 and 5.

In recent years, higher definition has been required to TV receivers. The market thus requires the PDP to be manufactured at a lower cost, to consume a lower power, and to be a full HD (high-definition, 1920×1080 pixels, and progressive display) with a higher brightness. The performance of emitting electrons from the protective layer determines the picture quality, so that it is vital for controlling the electron emission performance.

To be more specific, a video of higher definition needs a greater number of pixels to be addressed although a time for one field is kept as it has been, so that a width of a pulse, within an address period of a subfield, for applying a voltage to address electrodes should be narrowed. However, "a time lag" is present between a rise of a voltage pulse and a discharge into the discharge space. This time lag is referred to as a "discharge delay". A narrower pulse width thus lowers a probability of ending a discharge within an address period. As a result, a defective lighting occurs and flickers which degrade a video quality are produced.

A partial pressure of xenon (Xe), which is a component of the discharge gas that contributes to light emission of the phosphors, can be increased for improving an efficiency of light emission produced by the discharge so that the power consumption can be lowered. However, a greater discharge voltage invites a greater "discharge delay", thereby incurring a defective lighting which degrades a video quality.

As discussed above, the progress of PDP of higher definition and lower power consumption should be accompanied with the following two measures simultaneously: avoid increasing a discharge voltage, and decrease defective lightings to improve a video quality.

A protective layer added with impurities has been tested whether or not this addition can improve the electron emission performance; however, in a case where the performance can be improved, electric charges are stored on the surface of the protective layer to be used as a memory function. The number of electric charges decreases greatly with time, i.e. an attenuation rate becomes greater. To overcome this attenuation, measures is needed such as increment in an applied voltage.

In the protective layer containing material other than MgO, a discharge phenomenon is unstable under the influence of an ambient temperature.

On the other hand, forming the crystal particles of MgO on the protective layer made of MgO allows reducing a "discharge delay", thereby lowering the number of defective lightings; however, the discharge voltage cannot be lowered.

The present invention was made in view of the problems as thus described, and aims to realize a PDP which can display a video of higher brightness and yet can be driven at lower voltage, and which can steadily discharge with a scanning voltage not having a temperature dependence.

Patent Literature 1: Unexamined Japanese Patent Application Publication No. 2002-260535

Patent Literature 2: Unexamined Japanese Patent Application Publication No. H11-339665

Patent Literature 3: Unexamined Japanese Patent Application Publication No. 2006-59779

Patent Literature 4: Unexamined Japanese Patent Application Publication No. H08-236028

Patent Literature 5: Unexamined Japanese Patent Application Publication No. H10-334809

DISCLOSURE OF THE INVENTION

The PDP of the present invention is a plasma display panel including a first substrate with a display electrode formed on a board, a dielectric layer covering the display electrode, and a protective layer formed on the dielectric layer; and a second substrate opposing to the first substrate to form a discharge space filled with discharge gas, and including an address electrode formed along a direction intersecting with the display electrode, and a barrier rib partitioning the discharge space; wherein the protective layer is formed of a metal oxide made of magnesium oxide and calcium oxide and contains silicon, a diffraction angle where a peak of the metal oxide occurs existing between a diffraction angle where a peak of the magnesium oxide occurs and a diffraction angle where a peak of the calcium oxide, disposed along an identical orientation of the peak of the magnesium oxide, occurs in an X-ray diffraction analysis on a surface of the protective layer.

According to such configuration, the secondary electron emission characteristics in the protective layer are enhanced so that low voltage drive can be realized even if the partial pressure of the Xe gas of the, discharge gas is increased to boost the brightness. Further, a PDP capable of stably discharging with a scanning voltage not having a temperature dependence can be realized

PREFERRED EMBODIMENTS FOR CARRYING OUT OF THE INVENTION

A PDP in an exemplary embodiment of the present invention is demonstrated hereinafter with reference to the accompanying drawings.

Embodiment

Figure 1:
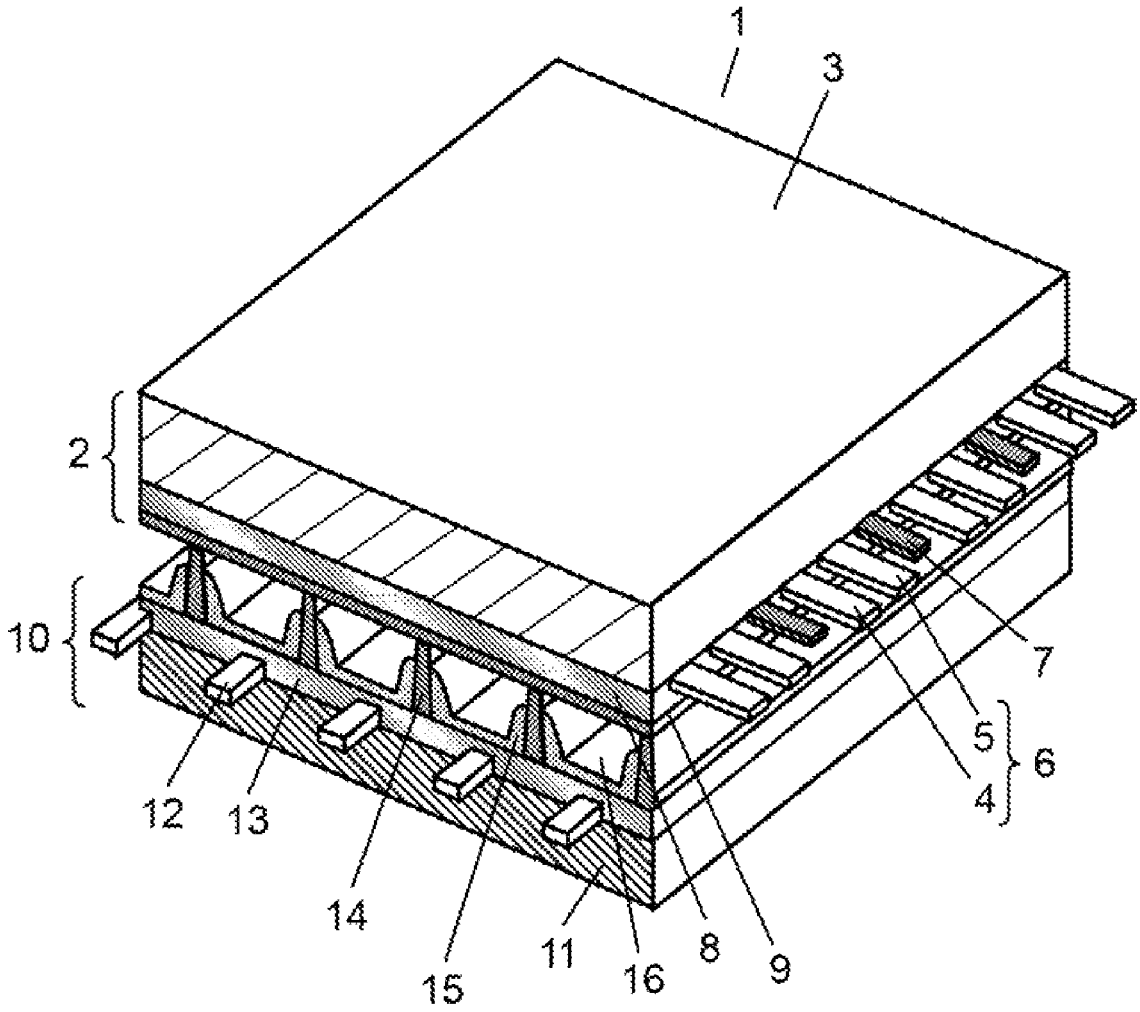
FIG. 1 shows a perspective view illustrating a structure of a PDP in accordance with an embodiment of the present invention.

FIG. 1 shows a perspective view illustrating a structure of PDP 1 in accordance with the embodiment of the present invention. PDP 1 is basically structured similarly to a PDP of AC surface discharge type generally used. As shown in FIG. 1, PDP 1 is formed of a first substrate (hereinafter referred to as front panel 2) including front glass substrate 3, and a second substrate (hereinafter referred to as rear panel 10) including rear glass substrate 11. Front panel 2 and rear panel 10 confront each other and the peripheries thereof are air tightly sealed with sealing agent such as glass frit, thereby forming discharge space 16, which is filled with discharge gas such as neon (Ne) and xenon (Xe) at a pressure falling within a range between 400 Torr and 600 Torr (between 53300 Pa and 80000 Pa).

Multiple pairs of belt-like display electrodes 6, each of which are formed of scan electrode 4 and sustain electrode 5, are placed in parallel with multiple black stripes (lightproof layers) 7 on front glass substrate 3 of front panel 2. Dielectric layer 8, retaining electric charges for working as a capacitor, is formed on front glass substrate 3 such that layer 8 can cover display electrodes 6 and lightproof layers 7. On top of that, protective layer 9 is formed on dielectric layer 8.

Multiple belt-like address electrodes 12 are placed in parallel with one another on rear glass substrate 11 of rear panel 10, and they are placed along a direction intersecting at right angles with scan electrodes 4 and sustain electrodes 5 formed on front panel 2. Primary dielectric layer 13 covers those address electrodes 12. Barrier ribs 14 having a given height are formed on primary dielectric layer 13 placed between respective address electrodes 12, and barrier ribs 14 partition discharge space 16. Phosphor layers 15 are applied onto each one of the grooves formed between each one of barrier ribs 14. Phosphor layers 15 emit light in red, blue, and green with radiation of ultraviolet rays thereto. A discharge space is formed at a junction point where scan electrode 14, sustain electrode 15 and address electrode 12 intersect with one another. The discharge spaces having phosphor layers 15 of red, blue, and green respectively are placed along display electrodes 6, and these spaces work as pixels for color display.

Figure 2:
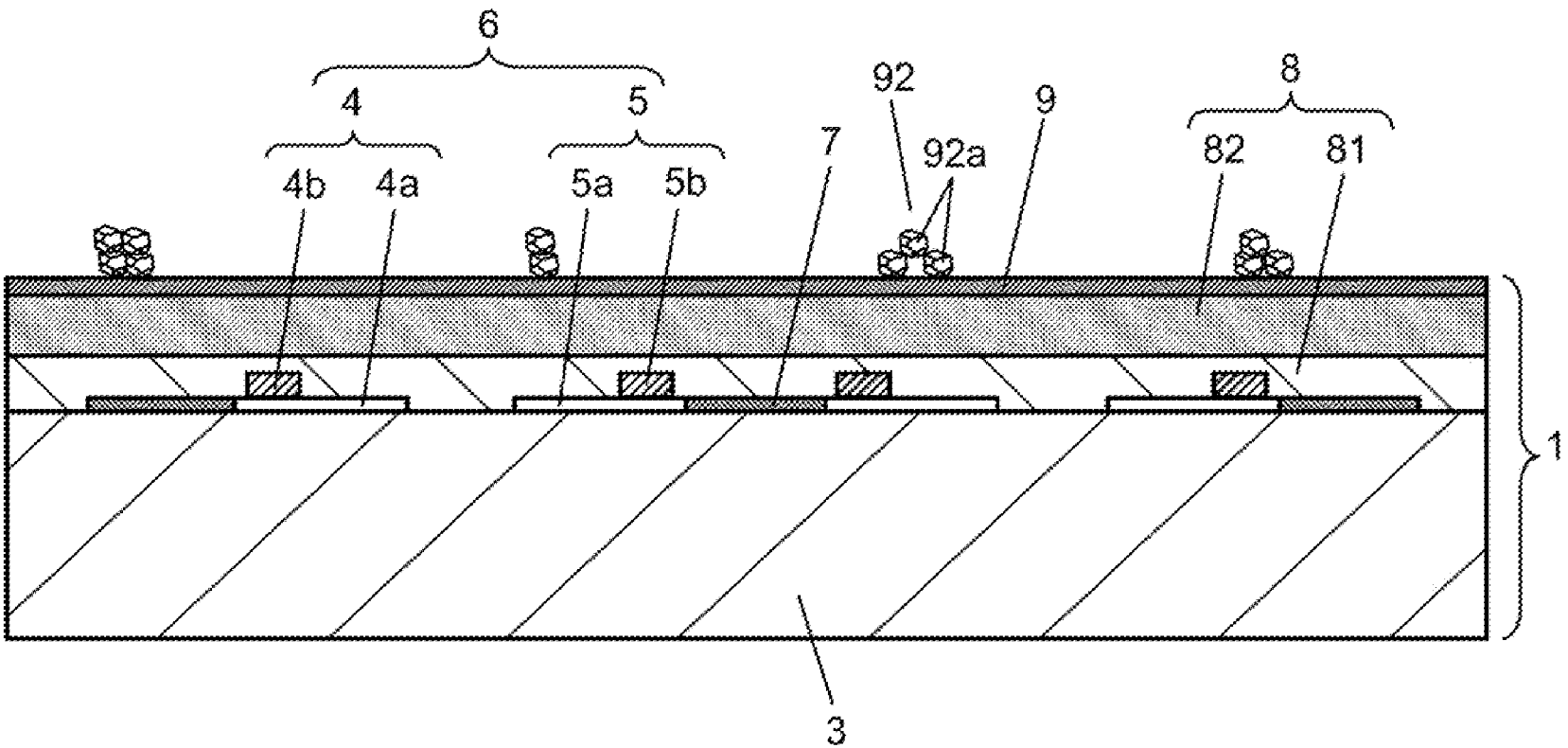
FIG. 2 shows a sectional view illustrating a structure of a front panel of the PDP.

FIG. 2 shows a sectional view illustrating a structure of front panel 2 of PDP 1 in accordance with this embodiment. Front panel 2 of FIG. 2 is turned upside down from front panel 2 shown in FIG. 1. As shown in FIG. 2, display electrodes 6 formed of scan electrodes 4 and sustain electrodes 5 are patterned on front glass substrate 3 manufactured by the float method. Lightproof layer 7 is also patterned together with display electrodes 6 on substrate 3. Scan electrode 4 and sustain electrode 5 are respectively formed of transparent electrodes 4*a*, 5*a* made of indium tin oxide (ITO) or tin oxide ($SnO_2$) and metal bus electrodes 4*b*, 5*b* formed on transparent electrodes 4*a*, 5*a*. Metal bus electrodes 4*b*, 5*b* give electrical conductivity to transparent electrodes 4*a*, 5*a* along the longitudinal direction of electrodes 4*a*, 5*a*, and they are made of conductive material of which chief ingredient is silver (Ag).

Dielectric layer 8 is formed of at least two layers, i.e. first dielectric layer 81 that covers transparent electrodes 4*a*, 5*a*, metal bus electrodes 4*b*, 5*b* and light proof layer 7 formed on front glass substrate 3, and second dielectric layer 82 formed on first dielectric layer 81. Protective layer 9 is formed on second dielectric layer 82.

Protective layer 9 is made of the metal oxide formed of magnesium oxide and calcium oxide, and on top of that, aggregated particles 92 are attached onto protective layer 9. Each one of aggregated particles 92 is formed by aggregating multiple crystal particles 92*a* of magnesium oxide (MgO).

Next, a method of manufacturing PDP 1 discussed above is demonstrated hereinafter. First, form scan electrodes 4, sustain electrodes 5, and lightproof layers 7 on front glass substrate 3. Scan electrode 4 and sustain electrode 5 are respectively formed of transparent electrodes 4*a*, 5*a* and metal bus electrodes 4*b*, 5*b*. These transparent electrodes 4*a*, 5*a*, and metal bus electrodes 4*b*, 5*b* are patterned by a photo-lithography method. Transparent electrodes 4*a*, 5*a* are formed by using, e.g. a thin-film process, and metal bus electrodes 4*b*, 5*b* are made by firing the paste containing silver (Ag) at a given temperature before the paste is hardened. Lightproof layer 7 is made by screen-printing the paste containing, black pigment, or by forming the black pigment on the entire surface of the glass substrate, and then patterning the pigment by the photolithography method before the paste is fired.

Next, apply dielectric paste onto front glass substrate 3 by a die-coating method such that the paste can cover scan electrodes 4, sustain electrodes 5, and lightproof layers 7, thereby forming a dielectric paste layer (dielectric material layer, not shown). Then leave front glass substrate 3, on which dielectric paste is applied, for a given time as it is, so that the surface of the dielectric paste is leveled to be flat. Then fire and harden the dielectric paste layer for forming dielectric layer 8 which covers scan electrodes 4, sustain electrodes 5 and lightproof layers 7. The dielectric paste is a kind of paint containing binder, solvent, and dielectric material such as glass powder.

Next, form protective layer 9 on dielectric layer 8. In this embodiment, protective layer 9 is made of a metal oxide formed of magnesium oxide (MgO) and calcium oxide (CaO).

Protective layer 9 is manufactured by a thin-film deposition method using the pellets made of magnesium oxide (MgO) only or calcium oxide (CaO) only or the pellets formed by mixing these materials. The thin-film deposition method includes, e.g. electron-beam evaporation method, sputtering method, ion-plating method. These methods are widely known in the industry. For instance, the sputtering method uses a pressure of 1 Pa as a practical upper limit, and the electron-beam evaporation method uses a pressure of 0.1 Pa as a practical upper limit.

The atmosphere during the deposition of protective layer 9 should be an airtight state isolated from the outside in order to prevent water or impurity from attaching to protective layer 9. Accordingly, the atmosphere is adjusted so that protective layer 9 formed of the metal oxide, which has a given electron emission characteristics, can be formed.

Next, aggregated particle 92 to be attached onto protective layer 9 and formed by aggregating crystal particles 92*a* of magnesium oxide (MgO) is described hereinafter. Crystal particles 92*a* are manufactured by the following vapor-phase synthesizing method or the precursor firing method.

The vapor-phase synthesizing method heats magnesium metal material having the purity of over 99.9% in the atmosphere filled with inert gas, and then a small amount of oxygen is supplied into the atmosphere to directly oxidize the magnesium, thereby manufacturing crystal particles 92*a* of magnesium oxide (MgO).

The precursor firing method fires the precursor of magnesium oxide (MgO) uniformly at 700° C. or higher than 700° C., and then cools it slowly for obtaining crystal particles 92*a* of magnesium oxide (MgO). The precursor can be at least one of the compounds selected from the group consisting of magnesium alcoxide ($Mg(OR)_2$), magnesium acetyl acetone ($Mg(acac)_2$), magnesium hydrate ($Mg(OH)_2$), magnesium carbonate ($MgCO_3$), magnesium chloride ($MgCl_2$), magnesium sulfate ($MgSO_4$),magnesium nitrate ($Mg(NO_3)_2$), and magnesium oxlatate ($MgC_2O_4$). Although some selected compounds take a hydration form, this hydrated compound can be also used.

These compounds are adjusted such that the purity of magnesium oxide (MgO) can be not less than 99.95%, or more preferably, not less than 99.98%, because if these compounds contain impurity elements, such as some alkaline metal, boron (B), silicon (Si), iron (Fe), aluminum (Al), more than a certain amount, useless adhesion between particles or sintering is produced during the heat treatment. These impurities adversely affect the production of highly crystalline crystal particles 92*a* of magnesium oxide (MgO). It is thus necessary to adjust the precursor in advance by removing the impurity elements.

Disperse crystal particles 92*a* of magnesium oxide (MgO) thus obtained through one of the foregoing methods into solvent, then spray the surface of protective layer 9 with the resultant fluid-dispersion by a spraying method, screen printing method, or electrostatic coating method. Protective layer 9 then undergoes the steps of drying and firing for removing the solvent, whereby aggregated particles 92, each one of particles 92 is formed by aggregating multiple crystal particles 92*a* of magnesium oxide (MgO), are fixed on the surface of protective layer 9.

The predetermined structural elements (scan electrodes 4, sustain electrodes 5, lightproof layers 7, dielectric layer 8 and protective layer 9) are formed on front glass substrate 3 through the series of processes discussed above, whereby front panel 2 is completed.

Rear panel 10 is formed this way: First, form a material layer (not shown), which is a structural element of address electrode 12, by screen-printing the paste containing silver (Ag) onto rear glass substrate 11, or by patterning with the photolithography method a metal film which is formed in advance on the entire surface of rear glass substrate 11. Then fire the material layer at a given temperature, thereby forming address electrodes 12. Next, form a dielectric paste layer on rear glass substrate 11, on which address electrodes 12 are formed, by applying dielectric paste onto substrate 11 with the die-coating method such that the layer can cover address electrodes 12. Then fire the dielectric paste layer for forming primary dielectric layer 13. The dielectric paste is a kind of paint which contains dielectric material, such as glass powder, binder and solvent.

Next, apply the paste containing the material for barrier rib onto primary dielectric layer 13, and pattern the paste into a given shape, thereby forming a barrier-rib layer. Then fire this barrier-rib layer at a given temperature for forming barrier ribs 14. The photolithography method or a sand-blasting method can be used for patterning the paste applied onto primary dielectric layer 13. Next, apply the phosphor paste containing phosphor material onto primary dielectric layer 13 surrounded by barrier ribs 14 adjacent to one another and also onto lateral walls of barrier ribs 14. Then fire the phosphor paste for forming phosphor layer 15. The foregoing steps allow completely forming rear panel 10, including the predetermined structural elements, on rear glass substrate 11.

Front panel 2 and rear panel 10 discussed above are placed confronting each other such that scan electrodes 4 intersect with address electrodes 12 at right angles, and the peripheries of panel 2 and panel 10 are sealed with glass frit to form discharge space 16 therebetween, and space 16 is filled with discharge gas including xenon (Xe) and neon (Ne). PDP 1 is thus completed.

First dielectric layer 81 and second dielectric layer 82 forming dielectric layer 8 of front panel 2 are detailed hereinafter. The dielectric material of first dielectric layer 81 is formed of the following compositions: bismuth oxide ($Bi_2O_3$) in 20 to 40 wt %; at least one composition in 0.5 to 12 wt % selected from the group consisting of calcium oxide (CaO), strontium oxide (SrO), and barium oxide (BaO); and at least one composition in 0.1 to 7 wt % selected from the group consisting of molybdenum oxide ($MoO_3$), tungstic oxide ($WO_3$), cerium oxide ($CeO_2$), and manganese dioxide ($MnO_2$).

At least one composition in 0.1 to 7 wt % selected from the group consisting of copper oxide (CuO), chromium oxide ($Cr_2O_3$), cobalt oxide ($CO_2O_3$), vanadium oxide ($V_2O_7$), and antimony oxide ($Sb_2O_3$) can replace the foregoing molybdenum oxide ($MoO_3$), tungstic oxide ($WO_3$), and cerium oxide ($CeO_2$), manganese dioxide ($MnO_2$).

Other than the foregoing compositions, the following compositions free from lead (Pb) can be contained in the dielectric material: zinc oxide (ZnO) in 0 to 40 wt %; boron oxide ($B_2O_3$) in 0 to 35 wt %; silicon dioxide ($SiO_2$) in 0 to 15 wt %, and aluminum oxide ($Al_2O_3$) in 0 to 10 wt %.

The dielectric material containing the foregoing compositions is grinded by a wet jet mill or a ball mill into powder of which particle diameter is between 0.5 μm and 2.5 μm. Next, this dielectric powder in 55 to 70 wt % and binder component in 30 to 45 wt % are mixed with a three-roll mill, so that the paste for first dielectric layer 81 to be used in the die-coating or the printing can be produced.

The binder component is formed of terpinol or butyl carbitol acetate which contains ethyl-cellulose or acrylic resin in 1 wt % to 20 wt %. The paste can contain, upon necessity, plasticizer such as dioctyl phthalate, dibutyl phthalate, triphenyl phosphate, tributyl phosphate, and dispersant such as glycerop mono-oleate, sorbitan sesquio-leate, homogenol (a product of Kao Corporation), alkyl-allyl based ester phosphate for improving the printing characteristics.

Next, the paste for the first dielectric layer discussed above is applied to front glass substrate 3 by the die-coating method or the screen-printing method such that the paste covers display electrodes 6, before the paste is dried. The paste is then fired at 575 to 590° C. a little bit higher than the softening point of the dielectric material, thereby forming first dielectric layer 81.

Second dielectric layer 82 is detailed hereinafter. The dielectric material of second dielectric layer 82 is formed of the following compositions: bismuth oxide ($Bi_2O_3$) in 11 to 20 wt %; at least one composition in 1.6 to 21 wt % selected from the group consisting of calcium oxide (CaO), strontium oxide (SrO), and barium oxide (BaO); and at least one composition in 0.1 to 7 wt % selected from the group consisting of molybdenum oxide ($MoO_3$), tungstic oxide ($WO_3$), and cerium oxide ($CeO_2$).

At least one composition in 0.1 to 7 wt % selected from the group consisting of copper oxide (CuO), chromium oxide ($Cr_2O_3$), cobalt oxide ($CO_2O_3$), vanadium oxide ($V_2O_7$), antimony oxide ($Sb_2O_3$), and manganese dioxide ($MnO_2$) can replace the foregoing molybdenum oxide ($MoO_3$), tungstic oxide ($WO_3$), and cerium oxide ($CeO_2$).

Other than the foregoing compositions, the following compositions free from lead (Pb) can be contained in the dielectric material: zinc oxide (ZnO) in 0 to 40 wt %; boron oxide ($B_2O_3$) in 0 to 35 wt %; silicon dioxide ($SiO_2$) in 0 to 15 wt %, and aluminum oxide ($Al_2O_3$) in 0 to 10 wt %.

The dielectric material containing the foregoing compositions is grinded by the wet jet mill or the ball mill into powder of which particle diameter is 0.5 μm to 2.5 μm. Next, this dielectric powder in 55 to 70 wt % and binder component in 30 to 45 wt % are mixed with a three-roll mill, so that the paste for the second dielectric layer to be used in the die-coating or the printing can be produced. The binder component is formed of terpinol or butyl carbitol acetate which contains ethyl-cellulose or acrylic resin in 1 wt % to 20 wt %. The paste can contain, upon necessity, plasticizer such as dioctyl phthalate, dibutyl phthalate, triphenyl phosphate, tributyl phosphate, and dispersant such as glycerop mono-oleate, sorbitan sesquio-leate, homogenol (a product of Kao Corporation), alkyl-allyl based ester phosphate for improving the printing performance.

Then the paste of the second dielectric layer discussed above is applied onto first dielectric layer 81 by the die-coating method or the screen-printing method before the paste is dried. The paste is then fired at 550 to 590° C. a little bit higher than the softening point of the dielectric material.

The film thickness of dielectric layer 8 (total thickness of first layer 81 and second layer 82) is preferably not greater than 41 μm in order to maintain the visible light transmission. First dielectric layer 81 contains a greater amount (20 to 40 wt %) of bismuth oxide ($Bi_2O_3$) than the amount thereof contained in second dielectric layer 82 in order to suppress the reaction of metal bus electrodes 4*b*, 5*b* with silver (Ag), so that first layer 81 is obliged to have a visible light transmittance lower than that of second layer 82. To overcome this problem, first layer 81 is formed thinner than second layer 82.

If second dielectric layer 82 contains bismuth oxide ($Bi_2O_3$) not greater than 11 wt %, it resists to be colored; however, air bubbles tend to occur in second layer 82, so that the content of not greater than 11 wt % is undesirable. On the other hand, if the content exceeds 40 wt %, second layer 82 tends to be colored, which incurs a decrease in the light transmittance.

A brightness of PDP advantageously increases and a discharge voltage also advantageously lowers at a thinner film thickness of dielectric layer 8, so that the film thickness is desirably set as thin as possible insofar as the breakdown voltage is not lowered. Considering these conditions, the film thickness of dielectric layer 8 is set not greater than 41 μm in this embodiment. To be more specific, first dielectric layer 81 has a thickness of 5 to 15 μm and second dielectric layer 82 has a thickness of 20 to 36 μm.

PDP 1 thus manufactured invites little coloring (yellowing) in front glass substrate 3 although display electrodes 6 are formed of silver (Ag), and yet, its dielectric layer 8 has no air bubbles, so that dielectric layer 8 excellent in breakdown voltage performance is achievable.

The dielectric materials discussed above allow first dielectric layer 81 of PDP 1 to have less yellowing or air bubbles. The reason is discussed hereinafter. It is known that the addition of molybdenum oxide ($MoO_3$) or tungstic oxide ($WO_3$) to the dielectric glass containing bismuth oxide ($Bi_2O_3$) tends to produce such chemical compounds as $Ag_2MoO_4$, $Ag_2Mo_2O_7$, $Ag_2Mo_4O_{13}$, $Ag_2WO_4$, $Ag_2W_2O_7$, $Ag_2W_4O_{13}$ at a temperature as low as 580° C. or lower than 580° C. Since dielectric layer 8 is fired at a temperature between 550° C. and 590° C. in this embodiment, silver ions ($Ag^+$) diffused in dielectric layer 8 during the firing react with molybdenum oxide ($MoO_3$), tungstic oxide ($WO_3$), cerium oxide ($CeO_2$), or manganese oxide ($MnO_2$) contained in dielectric layer 8, thereby producing a stable chemical compound. In other words, silver ions ($Ag^+$) are stabilized without having undergone the reduction, so that the silver ions are not aggregated, nor form colloid. A smaller amount of oxygen is thus produced because the colloid formation accompanies the oxygen production. As a result, the smaller amount of air bubbles is produced in dielectric layer 8.

To use the foregoing advantage more effectively, it is preferable for the dielectric glass containing the bismuth oxide ($Bi_2O_3$) to contain molybdenum oxide ($MoO_3$), tungstic oxide ($WO_3$), cerium oxide ($CeO_2$), or manganese oxide ($MnO_2$) at a content not less than 0.1 wt %, and it is more preferable that the content should be in the range from not smaller than 0.1 wt % to not greater than 7 wt %. The content less than 0.1 wt % will reduce the yellowing in only little amount, and the content over 7 wt % will produce coloring to the glass, so that the content out of the foregoing range is unfavorable.

To be more specific, first dielectric layer 81 placed closely to metal bus electrodes 4*b*, 5*b* made of Ag can reduce the yellowing and the air-bubbles, and second dielectric layer 82 placed on first dielectric layer 81 allows the light to transmit at a higher light transmittance. As a result, dielectric layer 8 as a whole allows the PDP to invite extremely smaller amounts of the air bubbles and the yellowing, and yet, allows the PDP to have the higher light transmittance.

Protective layer 9 in accordance with this embodiment is detailed hereinafter.

In accordance with the embodiment of the present invention, protective layer 9 is made of metal oxide which is formed of magnesium oxide (MgO) and calcium oxide (CaO) by using the electron-beam evaporation method, and contains a predetermined amount of silicon (Si). A diffraction angle where a peak of the metal oxide occurs exists between a diffraction angle where a peak of the magnesium oxide (MgO) occurs and a diffraction angle where a peak of the calcium oxide (CaO), disposed along an identical orientation as the peak of the magnesium oxide (MgO), occurs when the surface of protective layer 9 undergoes X-ray diffraction analysis.

Figure 3:
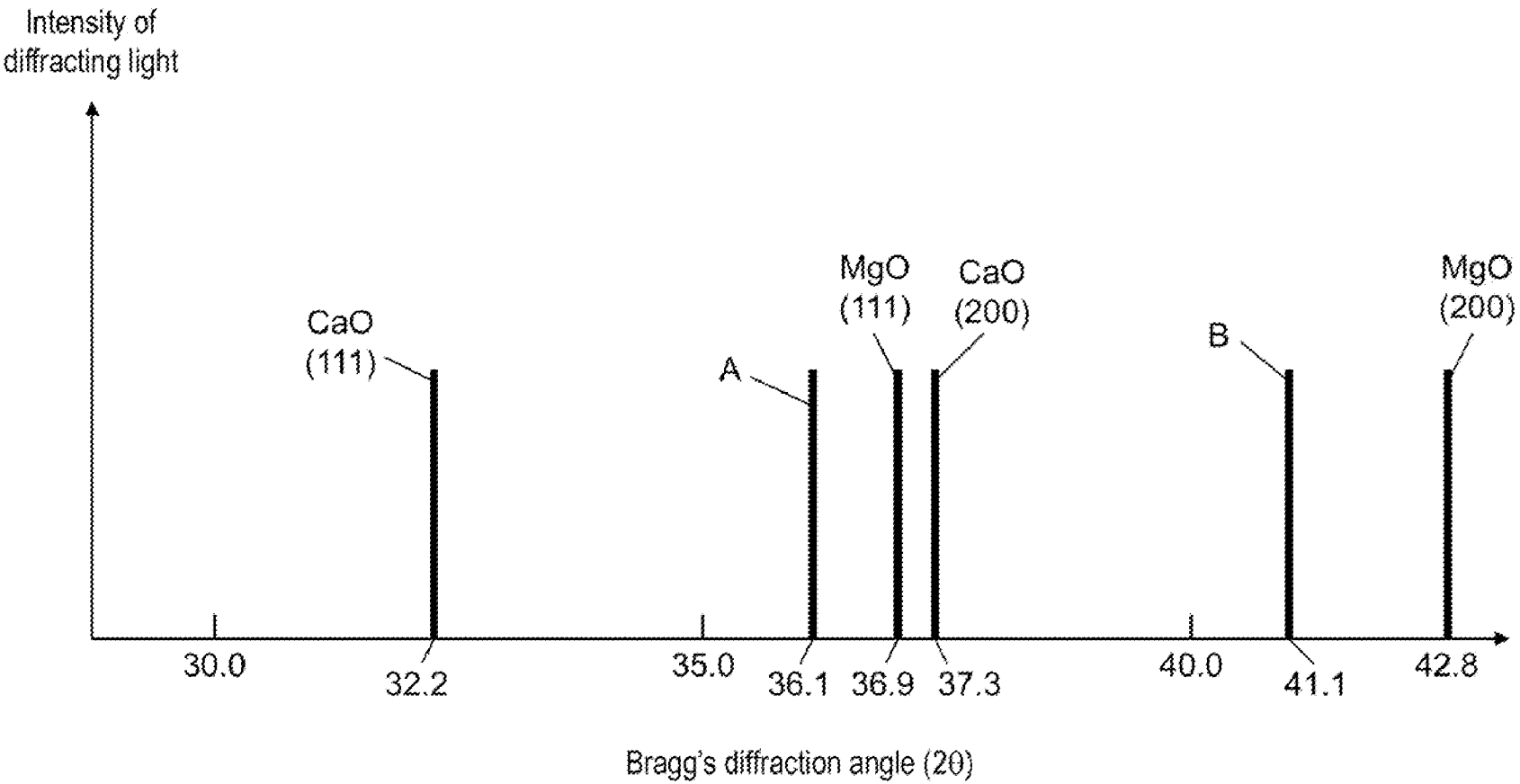
FIG. 3 shows the result of X-ray diffraction analysis on the protective layer of the PDP.

FIG. 3 shows the result of X-ray diffraction analysis on protective layer 9 of PDP 1, and the result thereof on simple chemical element of magnesium oxide (MgO) and that of calcium oxide (CaO).

In FIG. 3, the horizontal axis represents Bragg's diffraction angle (2θ), and the vertical axis represents intensity of X-ray diffracting light. A unit of diffraction angle is expressed with a degree of one round represented by 360°, and the intensity thereof can be described arbitrarily. Each orientation of crystal plane is written in parentheses in FIG. 3, which shows that the diffraction angle on the orientation of crystal plane (111) of simple chemical element of calcium oxide (CaO) has a peak at 32.2 degrees, and the diffraction angle of simple chemical element of magnesium oxide (MgO) has a peak at 36.9 degrees.

In a similar way, the diffraction angle on the orientation of crystal plane (200) of simple chemical element of calcium oxide (CaO) has a peak at 37.3 degrees and that of simple chemical element of magnesium oxide (MgO) has a peak at 42.8 degrees.

On the other hand, protective layer 9 is formed by the thin-film deposition method using the pellets made of simple chemical element of magnesium oxide (MgO) or calcium oxide (CaO), or the pellets made by mixing these elements. This protective layer 9 undergoes the X-ray diffraction analysis, and the results are shown at points A and B in FIG. 3.

In other words, the result of the X-ray diffraction analysis on the metal oxide of protective layer 9 in accordance with the embodiment of the present invention is such that the diffraction angle on (111) plane has a peak at point A (diffraction angle 36.1 degrees), which locates between the diffraction angles of the simple chemical elements, and the diffraction angle on (200) plane has a peak at point B (diffraction angle 41.1 degrees), which locates between the diffraction angles of the simple chemical elements.

The orientation of crystal plane of protective layer 9 is determined by the deposition condition and the ratio of the magnesium oxide (MgO) and the calcium oxide (CaO), but the peak of protective layer 9 exists between the peaks of the simple chemical elements in the embodiment of the present invention.

The energy level of the metal oxide having the foregoing properties is also present between the simple chemical element of magnesium oxide (MgO) and the simple chemical element of calcium oxide (CaO). As a result, protective layer 9 exerts better secondary emission characteristics than the simple chemical element of magnesium oxide (MgO), so that in a case where a partial pressure of xenon (Xe) working as discharge gas is increased in order to boost the brightness, the discharge voltage can be lowered, and yet a higher brightness of PDP driven with a lower voltage is achievable.

For instance, if a mixed gas of xenon (Xe) and neon (Ne) is used as the discharge gas, the brightness increases about 30% when the partial pressure of xenon (Xe) is increased from 10% to 15%. However, the discharge sustain voltage simultaneously rises about 10% if protective layer 9 of the simple chemical element of magnesium oxide (MgO) is used.

In the embodiment of the present invention, protective layer 9 is formed from a metal oxide consisting of magnesium oxide (MgO) and calcium oxide (CaO), and the diffraction angle at which the peak of the metal oxide occurs exists between the diffraction angle at which the peak of magnesium oxide (MgO) occurs and the diffraction angle at which the peak of calcium oxide (CaO) occurs in the X-ray diffraction analysis on the surface of protective layer 9. The discharge sustain voltage can be reduced about 10% by using such protective layer 9.

If the discharge gas is entirely xenon (Xe), that is, if the partial pressure of xenon (Xe) is 100%, the brightness increases about 180%, but at the same time, the discharge sustain voltage increases about 35% and exceeds the normal operation voltage range. However, the discharge sustain voltage can be reduced about 20% through the use of protective layer 9 in accordance with the embodiment of the present invention. The discharge sustain voltage within the normal operation range thus can be achieved. As a result, higher brightness of PDP driven at low voltage is achievable.

The reason why protective layer 9 in accordance with this embodiment can lower its discharge-sustain voltage is due to a band structure of each one of the metal oxides.

To be more specific, a depth of the valence band of calcium oxide (CaO) from the vacuum level is present in a shallower region in comparison with that of magnesium oxide (MgO). In driving the PDP, the number of electrons emitted from the energy level of calcium oxide (CaO) is considered to be greater than that of magnesium oxide (MgO).

Protective layer 9 in accordance with this embodiment is chiefly made of magnesium oxide (MgO) and calcium oxide (CaO), and the diffraction-angle at which the peak of protective layer 9 occurs exists between the diffraction angles of the magnesium oxide (MgO) and the calcium oxide (CaO), both are simple chemical elements, in the X-ray diffraction analysis.

The foregoing metal oxide film has an energy level having properties synthesized with those of magnesium oxide (MgO) and calcium oxide (CaO). The energy level of protective layer 9 is thus present between those of magnesium oxide (MgO) and calcium oxide (CaO), both are simple chemical elements. As a result, protective layer 9 exerts the secondary emission characteristics better than that of simple chemical element of magnesium oxide (MgO), and hence the discharge sustain voltage can be lowered.

The calcium oxide (CaO) is ready to react with impurities as it has high reactivity in simple chemical element, and thus the electron emission performance lowers. However, the reactivity can be lowered to overcome this problem by adopting the metal oxide formed of magnesium oxide (MgO) and calcium oxide (CaO) as in the embodiment of the present invention.

The depth from the vacuum level of strontium oxide (SrO) and barium oxide (BaO) is present at a shallower region than that of magnesium oxide (MgO) due to a band structure. Therefore, similar effects can be maintained by using such material in place of the calcium oxide (CaO).

On top of that, protective layer 9 in accordance with this embodiment is chiefly made of calcium oxide (CaO) and magnesium oxide (MgO), and the diffraction angle at which the peak of protective layer 9 occurs exists between the diffraction angles of the magnesium oxide (MgO) and the calcium oxide (CaO), both are simple chemical elements, in the X-ray diffraction analysis, and hence protective layer 9 is formed of crystal structure having little impurities mixed, and a rare oxygen deficiency. As a result, an excess emission of electrons can be suppressed when the PDP is driven. Both lower voltage driving and excellent secondary emission characteristics can be thus achieved, and on top of that, appropriate electric-charge retaining performance can be obtained. This electric-charge retaining performance is needed for retaining the wall charges stored during the initializing period in order to carry out the address discharge positively by preventing defective addresses during the address period.

Aggregated particle 92 provided on protective layer 9 and formed by aggregating multiple crystal particles 92*a* of magnesium oxide (MgO) in accordance with the embodiment of the present invention is detailed hereinafter. Experiments done by the inventors of the present invention prove that aggregated particle 92 produces the advantages of suppressing discharge-delay in address discharge, and improving the temperature dependence of the discharge-delay. To be more specific, aggregated particle 92 has primary-electron emission characteristics more excellent than that of protective layer 9. In the embodiment of the present invention, aggregated particle 92 is thus used as a primary-electron supplier which is needed when a discharge pulse rises.

At the start of discharge, a primary electron, which becomes the trigger, emits from the surface of protective layer 9 into discharge space 16. Shortage of amount of the primary electrons chiefly causes the discharge-delay. Aggregated particles 92 of magnesium oxide (MgO) are thus dispersed on the surface of protective layer 9 in order to supply the primary electrons steadily. This structure allows a good supply of the primary electrons to exist in discharge space 16 for eliminating the discharge-delay. This primary-electron emission characteristic thus allows a high-speed driving of excellent discharge-responsiveness even if. PDP 1 is of high definition display. Aggregated particles 92 of magnesium oxide (MgO) are dispersed on the surface of protective layer 9, and this structure chiefly produces an advantage that the discharge-delay during the address discharge can be prevented, and on top of that, the temperature dependency of discharge-delay can be also improved.

As discussed above, PDP 1 in accordance with the embodiment of the present invention includes protective layer 9 which can simultaneously produce the advantages of lower voltage drive and electric-charge retaining characteristics, and crystal particles 92*a* of magnesium oxide (MgO), for preventing the discharge-delay. This structure allows PDP 1 of high definition display to be driven with a lower voltage, and achieving a quality picture by suppressing the defective lightings.

Figure 4:
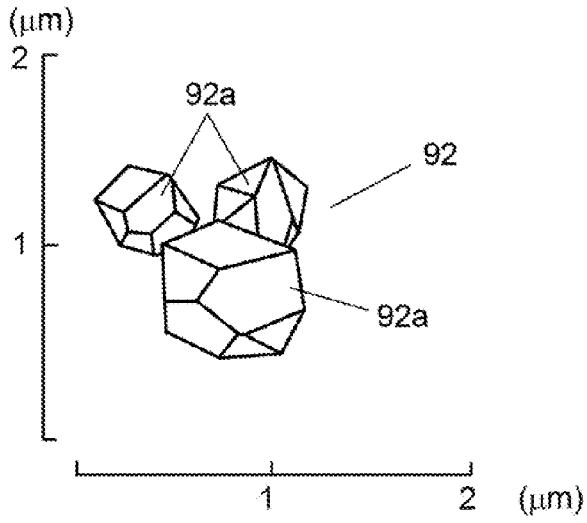
FIG. 4 shows an enlarged view of an aggregated particle of the PDP.

In accordance with the embodiment of the present invention, aggregated particles 92 formed by aggregating multiple crystal particles 92*a* are discretely scattered on protective layer 9 and attached in plurals to be distributed substantially evenly over the entire surface. FIG. 4 is an enlarged view for describing aggregated particle 92.

As shown in FIG. 4, primary crystal particles 92*a* having given diameters are aggregated into aggregated particle 92. In other words, aggregated particle 92 is not formed by bonding particles 92*a* together like a solid body with great bonding force, but multiple primary particles 92*a* simply form an aggregate with static electricity or van der Waals force. Thus parts of or all of aggregated particle 92 gather one another as weak as they turned into primary particles by external stimulus, such as an ultrasonic wave, to thereby form aggregated particle 92. The particle diameter of aggregated particle 92 is approx. 1 μm, and crystal particle 92*a* desirably forms a polyhedral shape having seven faces or more than seven faces such as 14 faces or 12 faces.

The particle diameter of the primary particle of crystal particles 92*a* can be controlled depending on a manufacturing condition of crystal particles 92*a*. For instance, when crystal particles 92*a* are formed by firing the magnesium oxide (MgO) precursor, e.g. magnesium carbonate or magnesium hydroxide, the firing temperature or the firing atmosphere is controlled, whereby the particle diameter can be controlled. In general, the firing temperature can be selected from the range of 700 to 1500° C., but a relatively high firing temperature over 1000° C. allows the diameter of the primary particle to be within the range of 0.3 to 2 μm. Crystal particle 92*a* can be obtained by heating the precursor of magnesium oxide (MgO), and during its production steps, multiple primary particles are aggregated together, whereby aggregated particle 92 can be obtained.

Figure 5:
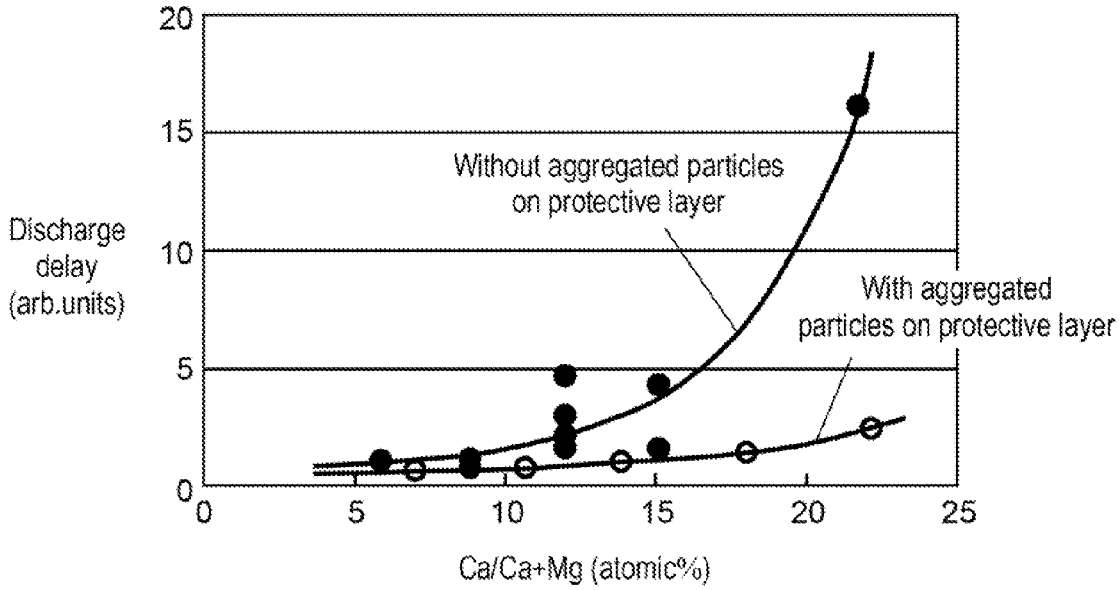
FIG. 5 shows relations between a discharge delay of the PDP and the density of calcium in the protective layer.

FIG. 5 shows the relation between the discharge-delay of PDP 1 in accordance with the embodiment of the present invention and the density of calcium (Ca) contained in protective layer 9, which includes the metal oxide formed of magnesium oxide (MgO) and calcium oxide (CaO). On top of that, the diffraction angle where the peak of the metal oxide occurs exists between the diffraction angle where the peak of the magnesium oxide (MgO) occurs and the diffraction angle where the peak of the calcium oxide (CaO) occurs in the X-ray diffraction analysis on the surface of protective layer 9.

FIG. 5 shows a case where only protective layer 9 is formed and a case where aggregated particle 92 is arranged on protective layer 9. The discharge delay is shown with a case where protective layer 9 does not contain calcium (Ca) as a reference.

The electron emission performance is expressed with a numeral indicating greater amount of electron emission with a greater numeral, and the numeral is expressed with a primary electron emission amount which is determined by the surface condition and the type of gas. The emission amount of the primary electrons can be measured by irradiating the surface of protective layer 9 with ions or an electron beam, and measuring an amount of electron current emitted from the surface. However, it is difficult to evaluate the surface of the front panel of the PDP by the non-destructive inspection method, so that the inventors use the method disclosed in the Unexamined Japanese Patent Application Publication No. 2007-48733. To be more specific, a numeral called a statistical delay-time which can be a guideline of easiness of discharge occurrence is measured, and then the reciprocal of the numeral is integrated to obtain the numeral that corresponds linearly to the emission amount of the primary electrons. This resultant numeral is used for the evaluation. A delay time at a discharge indicates a time lag between a rise of a pulse and a start of a discharge. This discharge-delay is chiefly caused by the fact that the primary electrons, which are supposed to trigger the discharge, cannot emit easily from the surface of the protective layer into the discharge space.

As FIG. 5 explicitly shows, comparing the case where only protective layer 9 is formed with the case where aggregated particle 92 is formed on protective layer 9, the discharge-delay becomes greater at the higher density of calcium (Ca). On the other hand, in the case where aggregated particle 92 is arranged on protective layer 9, the discharge-delay becomes substantially smaller, and a higher density of calcium (Ca) invites little increase in the discharge-delay.

Figure 6:
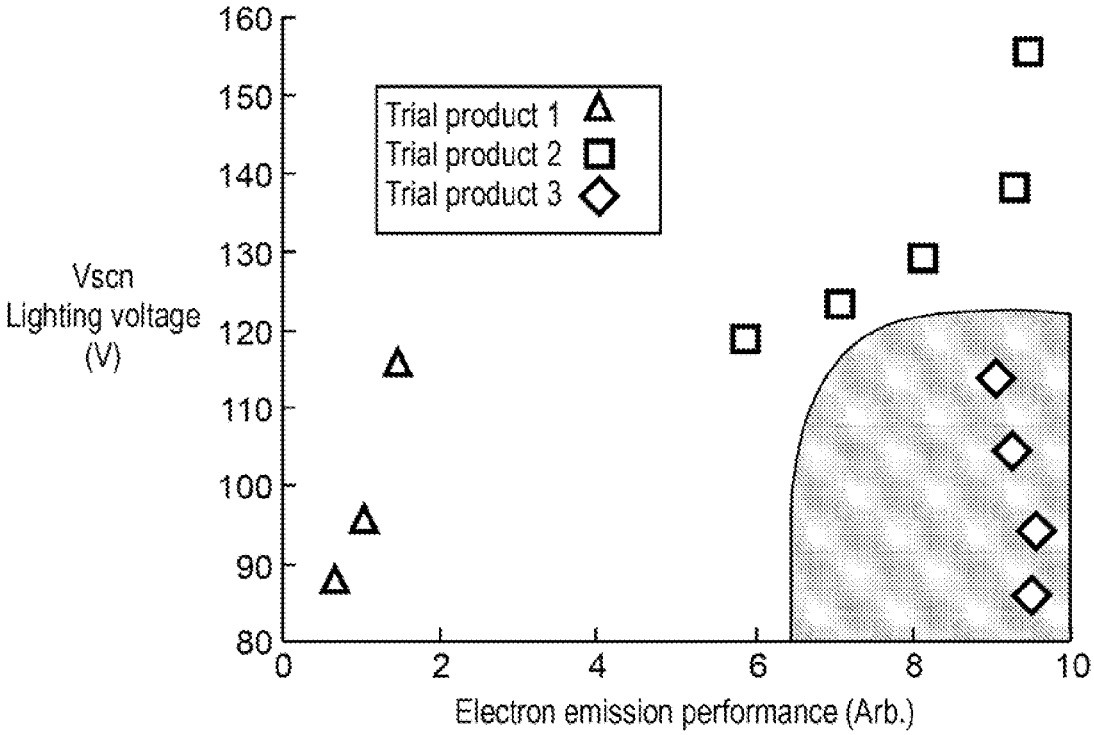
FIG. 6 is a view showing the results of examining the electron emission performance and the lighting voltage of the PDP in accordance with the embodiment of the present invention.

The result of the experiment conducted to check the effect of PDP 1 including protective layer 9 in accordance with the embodiment of the present invention will now be described. First, PDPs including protective layer 9 having a different configuration and crystal particles 92*a* arranged on protective layer 9 were trial manufactured. The results of examining the electron emission performance and the electric charge retaining performance on such PDPs are shown in FIG. 6.

Trial product 1 is a PDP formed only with protective layer 9 of magnesium oxide (MgO), and trial product 2 is a PDP formed with protective layer 9 in which only impurities such as aluminum (Al) and silicon (Si) are doped in the magnesium oxide (MgO).

Trial product 3 is PDP 1 in accordance with the embodiment of the present invention. To be more precise, protective layer 9 is chiefly made of calcium oxide (CaO) and magnesium oxide (MgO), and also silicon (Si). In the X-diffraction analysis, the diffraction angle where the peak of protective layer 9 occurs exists between the diffraction angles of the chief components, the magnesium oxide (MgO) and the calcium oxide (CaO), both of which are simple chemical elements. Aggregated particle 92 formed by aggregating crystal particles 92*a* are attached on protective layer 9 so as to be substantially evenly distributed over the entire surface.

The voltage value of the voltage (hereinafter referred to as Vscn lighting voltage) to apply to the scan electrode required to suppress the electric charge emission phenomenon when fabricated as the PDP was used for the index of the electric charge retaining performance. In other words, lower Vscn lighting voltage indicates higher electric charge retaining performance. This allows components of small withstand voltage and capacity to be used for the power supply and each electrical component in designing the PDP. In the current product, an element having a withstand voltage of about 150V is used for the semiconductor switching element such as a MOSFET for sequentially applying the Vscn lighting voltage. Therefore, the Vscn lighting voltage is desirably suppressed to smaller than or equal to 120V in view of fluctuation by temperature.

As apparent from FIG. 6, trial product 3, in which aggregated particle 92 formed by aggregating crystal particles 92*a* of magnesium oxide (MgO) is scattered on and evenly distributed over the entire surface of protective layer 9 in accordance with the embodiment of the present invention, allows the Vscn lighting voltage to be lower than or equal to 120V in the evaluation of the electric charge retaining performance. Furthermore, significantly satisfactory electron emission performance can be obtained compared to the protective layer of only the magnesium oxide (MgO).

Generally, the electron emission performance and the electric charge retaining performance of the protective layer of the PDP contradict each other. For instance, the electron emission performance can be enhanced by changing the film-fabricating conditions of the protective layer or by fabricating, the film with impurities such as aluminum (Al), silicon (Si), and barium (Ba) simply doped in the protective layer, but the Vscn lighting voltage rises as a side effect.

PDP 1 of trial product 3 formed with protective layer 9 in accordance with the embodiment of the present invention has an electron emission performance of eight times or greater than trial product 1 using protective layer 9 made only of the magnesium oxide (MgO). The electric charge retaining performance in which the Vscn lighting voltage is smaller than or equal to 120V can be obtained. Therefore, the number of scanning lines increases by higher definition, and both the electron emission performance and the electric charge retaining performance can be satisfied with respect to the PDP in which the size tends to become smaller.

Figure 7:
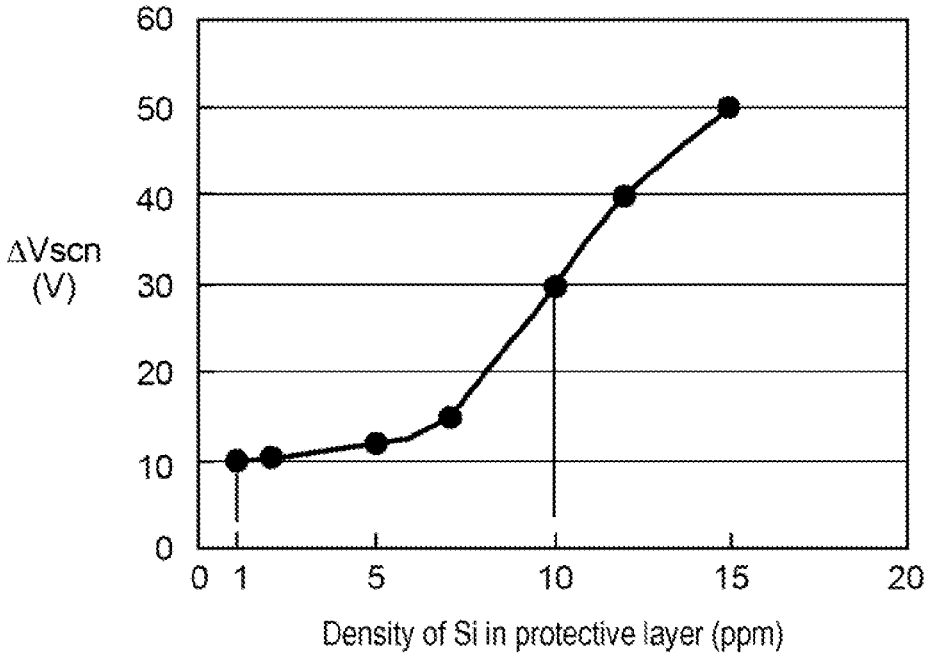
FIG. 7 is a view showing the density of silicon (Si) contained in the protective layer of the PDP and the temperature dependence of the Vscn lighting voltage.

The effects of silicon (Si) contained in the protective layer 9 will be described below. FIG. 7 is a view showing the temperature dependence of the Vscn lighting voltage with respect to the density of silicon (Si) contained in protective layer 9 in PDP 1, namely trial product 3, in accordance with the embodiment of the present invention.

Experiments done by the inventors of the present invention prove that, in the case of protective layer 9 chiefly made of calcium oxide (CaO) and magnesium oxide (MgO), controlling the amount of silicon (Si) contained in protective layer 9 can reduce the temperature dependence of the Vscn lighting voltage.

In FIG. 7, the horizontal axis represents the density of silicon (Si) in protective layer 9, and the vertical axis represents the difference between a Vscn lighting voltage in the case of operating PDP1 in an environment at 70° C. and a Vscn lighting voltage in the case of operating the same in an environment at 30° C. Here, ΔVscn=Vscn (70° C.)−Vscn (30° C.). Therefore, with a smaller ΔVscn value, the Vscn lighting voltage has a smaller temperature dependence, so that stable discharge can be performed without the influence of the ambient environment. The density of silicon (Si) in protective layer 9 is measured using a secondary ion mass spectrometer (SIMS).

As FIG. 7 explicitly shows, the temperature dependence of the Vscn lighting voltage increases with increase in silicon (Si) in protective layer 9, and when the density of silicon (Si) exceeds 10 ppm, ΔVscn exceeds 30 V, which is undesirable as an actual operation of PDP1. As for the operation of PDP1, ΔVscn is desirably smaller than or equal to 30 V due to operating characteristics of the semiconductor switching element, and the like. Accordingly, containing silicon (Si) in protective layer 9 in an amount smaller than or equal to 10 ppm can reduce the temperature dependence of the Vscn lighting voltage so as to stabilize the discharge, in addition to the foregoing effect of being chiefly composed of calcium oxide (CaO) and magnesium oxide (MgO). Further, making the density of silicon (Si) in protective layer 9 smaller than or equal to 7 ppm can further reduce the temperature dependence of ΔVscn.

Moreover, silicon (Si) may be contained in an amount larger than or equal to a detection limit of 1 ppm, measured by the secondary ion mass spectrometer (SIMS).

Next, a diameter of aggregated particle 92 used in protective layer 9 of PDP 1 in accordance with the embodiment of the present invention will be described. A diameter of a particle refers to an average diameter, which means a cumulative volumetric average diameter (D50).

Figure 8:
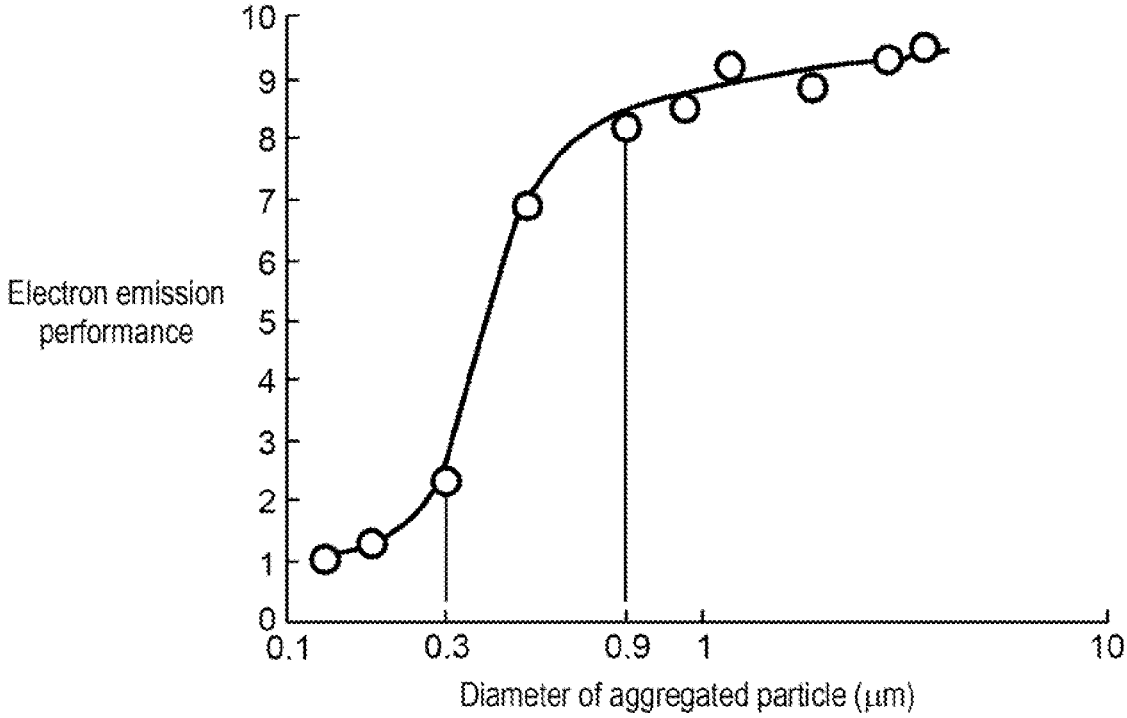
FIG. 8 is a characteristics diagram showing the relationship of the diameter of the aggregated particle used in the PDP and the electron emission characteristics.

FIG. 8 is a characteristics diagram showing an experimental result of examining the electron emission performance by varying the particle diameter of aggregated particle 92 in the trial product 3 of the present invention described in FIG. 6. In FIG. 8, the diameter of aggregated particle 92 is measured by viewing the sectional SEM photo of aggregated particle 92. As shown in FIG. 8, the electron emission performance lowers when the diameter decreases to as small as about 0.3 μm, and high electron emission performance can be achieved when the diameter is greater than or equal to substantially 0.9 μm.

To increase the number of electrons emitted within a discharge cell, it is desirable that a larger number of crystal particles 92*a* exist at a unit area on protective layer 9. However, the experiment done by the inventors of the present invention proved that, presence of aggregated particle 92 in area corresponding to the top of barrier rib 14 of rear panel 10, with which protective layer 9 of front panel 2 closely contacts, damages the top of barrier rib 14. Furthermore, the material of the broken rib may go on phosphor layer 15. Thus, the cell encountering this problem cannot normally turn on or off. This damage of the barrier rib resists occurring when aggregated particle 92 does not exist in the area corresponding to the top of barrier rib, so that a larger number of aggregated particles 92 to be attached will increase the occurrence of damages in barrier ribs 14. The probability of the damage of the barrier ribs sharply increases when the diameter of the aggregated particles increases to as large as about 2.5 μm, and the probability of the damage of the barrier ribs stays at a rather low level when the diameter of the aggregated particles is smaller than 2.5 μm.

As discussed above, the effects of the present invention described above can be stably obtained in PDP 1 according to the embodiment of the present invention if aggregated particle 92 having a diameter in a range of between 0.9 μm and 2 μm is used for aggregated particle 92.

As discussed above, according to the PDP of the present invention, a PDP in which electron emission performance is high and in which the electric charge retaining performance is such that the Vscn lighting voltage is smaller than or equal to 120V can be obtained.

The embodiment of the present invention has been described using the magnesium oxide (MgO) particles as crystal particles. However, other crystal particles of the materials having excellent electron emission performance similar to that of magnesium oxide (MgO), such as strontium oxide (SrO), calcium oxide (CaO), barium oxide (BaO) or aluminum oxide ($Al_2O_3$), can be used, and the use of crystal particles of those metal oxides allows producing advantages similar to what are discussed previously. The material of the particles is thus not limited to magnesium oxide (MgO) only.

INDUSTRIAL APPLICABILITY

The present invention is useful for achieving a PDP which can display a video of higher brightness and yet can be driven at lower voltage, and which can steadily discharge while suppressing the temperature dependence of the scanning voltage small.

REFERENCE MARKS IN THE DRAWINGS

1 PDP
2 front panel
3 front glass substrate
4 scan electrode
4*a*, 5*a* transparent electrode
4*b*, 5*b* metal bus electrode
5 sustain electrode
6 display electrode
7 black stripe (lightproof layer)
8 dielectric layer
9 protective layer
10 rear panel
11 rear glass substrate
12 address electrode
13 primary dielectric layer
14 barrier rib
15 phosphor layer
16 discharge space
81 first dielectric layer
82 second dielectric layer
92 aggregated particle
92*a* crystal particle

The invention claimed is:

1. A plasma display panel comprising:

a first substrate including a display electrode formed on a board, a dielectric layer covering the display electrode, and a protective layer formed on the dielectric layer; and a second substrate opposing to the first substrate to form a discharge space filled with discharge gas, and including an address electrode formed along a direction intersecting with the display electrode, and a barrier rib partitioning the discharge space; wherein the protective layer is formed of a metal oxide made of magnesium oxide and calcium oxide and contains silicon, a diffraction angle where a peak of the metal oxide occurs existing between a diffraction angle where a peak of the magnesium oxide occurs and a diffraction angle where a peak of the calcium oxide, disposed along an identical orientation of the peak of the magnesium oxide, occurs in an X-ray diffraction analysis on a surface of the protective layer, and the density of the silicon in the protective layer is within a range between 1 ppm and 10 ppm inclusive.

2. The plasma display panel according to claim 1, wherein an aggregated particle formed by aggregating multiple crystal particles of magnesium oxide is attached to the protective layer at a face confronting the discharge space.

* * * * *